US009957801B2

(12) United States Patent
Aggarwala et al.

(10) Patent No.: US 9,957,801 B2
(45) Date of Patent: May 1, 2018

(54) AIRFOIL DESIGN HAVING LOCALIZED SUCTION SIDE CURVATURES

(75) Inventors: Andrew S. Aggarwala, Vernon, CT (US); Eunice Allen-Bradley, Vernon, CT (US); Eric A. Grover, Tolland, CT (US); Ricardo Trindade, Coventry, CT (US)

(73) Assignee: United Technologies Corporation, Farmington, CT (US)

( * ) Notice: Subject to any disclaimer, the term of this patent is extended or adjusted under 35 U.S.C. 154(b) by 867 days.

(21) Appl. No.: 13/566,400

(22) Filed: Aug. 3, 2012

(65) Prior Publication Data

US 2014/0037459 A1 Feb. 6, 2014

(51) Int. Cl.
*F01D 5/14* (2006.01)
*F01D 5/18* (2006.01)

(52) U.S. Cl.
CPC ..... *F01D 5/141* (2013.01); *F01D 5/145* (2013.01); *F01D 5/148* (2013.01); *F01D 5/186* (2013.01); *F05D 2240/124* (2013.01); *F05D 2250/713* (2013.01)

(58) Field of Classification Search
CPC ..... F01D 5/148; F01D 5/141; F01D 5/145; F01D 5/186; F05D 2240/144; F05D 2250/712; F05D 2250/713; F05D 2240/124
USPC ..... 416/242
See application file for complete search history.

(56) References Cited

U.S. PATENT DOCUMENTS 2,406,499 A 8/1946 Jandasek
4,692,098 A * 9/1987 Razinsky et al. ..... 416/223 R
5,035,578 A 7/1991 Tran
5,088,894 A 2/1992 Patel
5,228,833 A 7/1993 Schonenberger et al.
5,292,230 A 3/1994 Brown
5,354,178 A 10/1994 Ferleger et al.
5,525,038 A 6/1996 Sharma et al.
5,554,000 A 9/1996 Katoh et al.
6,358,012 B1 * 3/2002 Staubach ..... 416/228
(Continued)

FOREIGN PATENT DOCUMENTS

WO WO2011147401 A1 12/2011

OTHER PUBLICATIONS

International Search Report and Written Opinion, dated Nov. 4, 2013.

(Continued)

*Primary Examiner* — Kenneth Bomberg
*Assistant Examiner* — Brian P Wolcott
(74) *Attorney, Agent, or Firm* — Kinney & Lange, P.A.

(57) ABSTRACT

An airfoil for a gas turbine engine comprises a radially extending body having a transverse cross-section. The transverse cross-section comprises a leading edge, a trailing edge, a pressure side and a suction side. The pressure side extends between the leading edge and the trailing edge with a predominantly concave curvature. The suction side extends between the leading edge and the trailing edge with a predominantly convex curvature. The suction side includes an approximately flat portion flanked by forward and aft convex portions. In another embodiment, the suction side includes a series of local curvature changes that produce inflection points in the convex curvature of the suction side spaced from the trailing edge.

16 Claims, 7 Drawing Sheets

(56) References Cited

U.S. PATENT DOCUMENTS

| | | | | |
|---|---|---|---|---|
| 6,776,582 | B2 | 8/2004 | Segawa et al. | |
| 6,802,474 | B2 | 10/2004 | Sonoda et al. | |
| 7,018,172 | B2 | 3/2006 | Prasad et al. | |
| 7,018,174 | B2 | 3/2006 | Senoo et al. | |
| 7,581,930 | B2 | 9/2009 | Aggarwala et al. | |
| RE42,370 | E | 5/2011 | Kuhne | |
| 8,118,560 | B2 | 2/2012 | Takahashi et al. | |
| 8,814,529 | B2 * | 8/2014 | Fiala et al. | 416/236 R |
| 2002/0021968 | A1 | 2/2002 | Olhofer et al. | |
| 2010/0014983 | A1 | 1/2010 | Takahashi et al. | |
| 2010/0074762 | A1 | 3/2010 | Liang | |
| 2011/0097210 | A1 * | 4/2011 | Kirtley | F01D 5/141 416/223 A |
| 2011/0123312 | A1 | 5/2011 | Venkataramanan et al. | |
| 2014/0017089 | A1 | 1/2014 | Ristau et al. | |

OTHER PUBLICATIONS

Extended European Search Report for Application No. 13826145.8, dated Jun. 15, 2016, 8 pages.

* cited by examiner

AIRFOIL DESIGN HAVING LOCALIZED SUCTION SIDE CURVATURES

BACKGROUND

The present invention is directed to airfoil components for gas turbine engines and, more particularly, to contouring of the airfoil.

Gas turbine engines operate by passing a volume of high-energy gases through a plurality of stages of vanes and blades in order to drive turbines to produce rotational shaft power. The shaft power drives a compressor to provide compressed air to a combustion process that generates the high-energy gases. Additionally, the shaft power may be used to drive a generator for producing electricity or to drive a fan for generating thrust. In order to produce gases having sufficient energy to drive the compressor and generator/fan, it is necessary to compress the air to elevated pressures and temperatures, and combust the air at even higher temperatures.

The vanes and blades each include an airfoil that extends through a flow path in which the high-energy gas moves. The turbine blade airfoils are typically connected at their inner diameter root sections to a rotor, which is connected to a shaft that rotates within the engine as the blades interact with the gas flow. The rotor typically comprises a disk having a plurality of axial retention slots that receive mating root portions of the blades to prevent radial dislodgment. Blades typically also include integral inner diameter platforms that prevent the high temperature gases from penetrating through to the retention slots. The turbine vane airfoils are typically suspended from an outer engine case at an outer shroud structure and include an inner shroud structure that aligns with the blade platforms.

The flow of the hot gas around each airfoil produces localized potential fields that interact with adjacent airfoil rows. For example, the rotating blade airfoils pass through and impact the static pressure field developed by the suction side of the upstream vane airfoils. These interactions adversely impact the effectiveness of each airfoil, thereby reducing the overall engine efficiency. Various approaches have been developed for addressing these suction side potential fields. For example, U.S. Pat. No. 6,358,012 to Staubach discusses providing a concave suction side contour between convex suction side contours at the throat of adjacent airfoils to reduce shock effects in supersonic blade applications. Also, U.S. Pat. No. 5,228,833 to Schönenberger et al. discusses placing a concave portion along the suction side extending a distance forward from the trailing edge equal to the throat length in order to mitigate losses associated with the deceleration of airflow along the suction side under subsonic conditions. U.S. Pat. No. 5,292,230 to Brown discloses placing a straight portion along the suction side from the trailing edge to a gauging point in a steam turbine vane airfoil. There is, however, a continuing need to improve the efficiency of airfoils, particularly with respect to reducing potential field interactions and increasing overall engine efficiency.

SUMMARY

The present invention is directed toward an airfoil for a gas turbine engine. The airfoil comprises a radially extending body having a transverse cross-section that includes a leading edge, a trailing edge, a pressure side and a suction side. The pressure side extends between the leading edge and the trailing edge with a predominantly concave curvature. The suction side extends between the leading edge and the trailing edge with a predominantly convex curvature. The suction side includes an approximately flat portion flanked by forward and aft convex portions. In another embodiment, the suction side includes a series of local curvature changes that produce inflection points in the convex curvature of the suction side spaced from the trailing edge.

DETAILED DESCRIPTION

Figure 1:
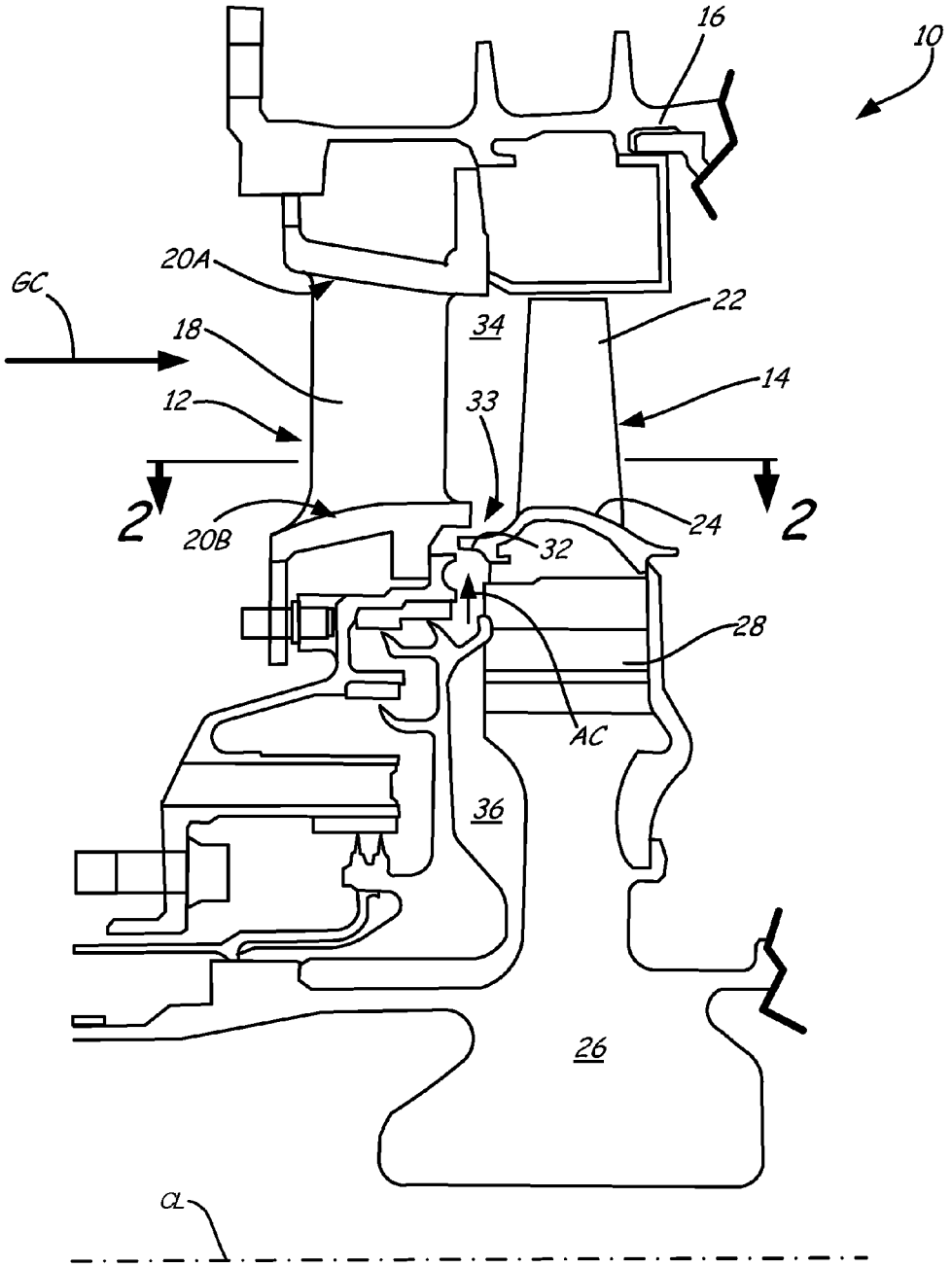
FIG. 1 is a schematic view of a high pressure turbine section of a gas turbine engine showing a stator vane and a rotor blade each having airfoils of the present invention.

FIG. 1 shows a schematic view of high pressure turbine section 10 of a gas turbine engine having inlet guide vane 12 and turbine blade 14 disposed within engine case 16. Inlet guide vane 12 comprises airfoil 18, which is suspended from turbine case 16 at its outer diameter end at shroud 20A and is retained at its inner diameter end by shroud 20B. Turbine blade 14 comprises airfoil 22, which extends radially outward from platform 24. Airfoil 22 and platform 24 are coupled to rotor disk 26 through firtree slot connection 28. Turbine blade 14 and rotor disk 26 rotate about engine centerline CL. Shroud 20B and fin 32 of platform 24 mate to form labyrinth seal 33 separating gas path 34 from cavity 36.

Airfoil 18 and airfoil 22 extend from their respective inner diameter supports toward engine case 16, across gas path 34. Hot combustion gases GC are generated within a combustor (not shown) upstream of turbine section 10 and flow through gas path 34. Airfoil 18 of inlet guide vane 12 turns the flow of gases GC to improve incidence on airfoil 22 of turbine blade 14. As such, airfoil 22 is better able to extract energy from gases GC. Specifically, gases GC impact airfoil 22 to cause rotation of turbine blade 14 and rotor disk 26 about centerline CL. Due to the elevated temperatures of gases GC, cooling air AC is provided to the interior of shroud 20B and platform 22 to purge hot gas from cavity 36. For example, cooling air AC, which is relatively cooler than hot gases GC may be routed from a high pressure compressor stage (not shown) driven by high pressure turbine stage 10. Likewise, airfoils 18 and 22 include internal cooling passages (not shown) to receive portions of cooling air AC.

Figure 4A:
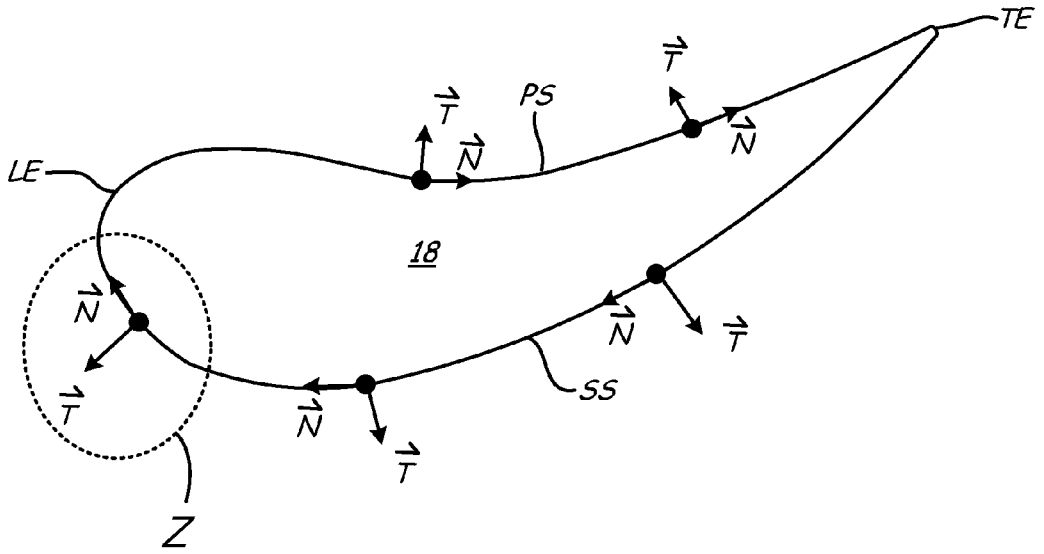
FIG. 4A is schematic cross-section of the airfoil of the high pressure stator vane of FIG. 3 showing a local coordinate system for determining curvature of the airfoil.
Figure 4B:
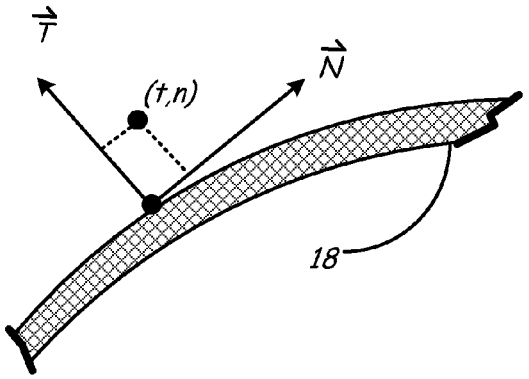
FIG. 4B is a close-up of callout Z of FIG. 4A showing orthogonal tangent and normal vectors of the local airfoil coordinate system.
Figure 5:
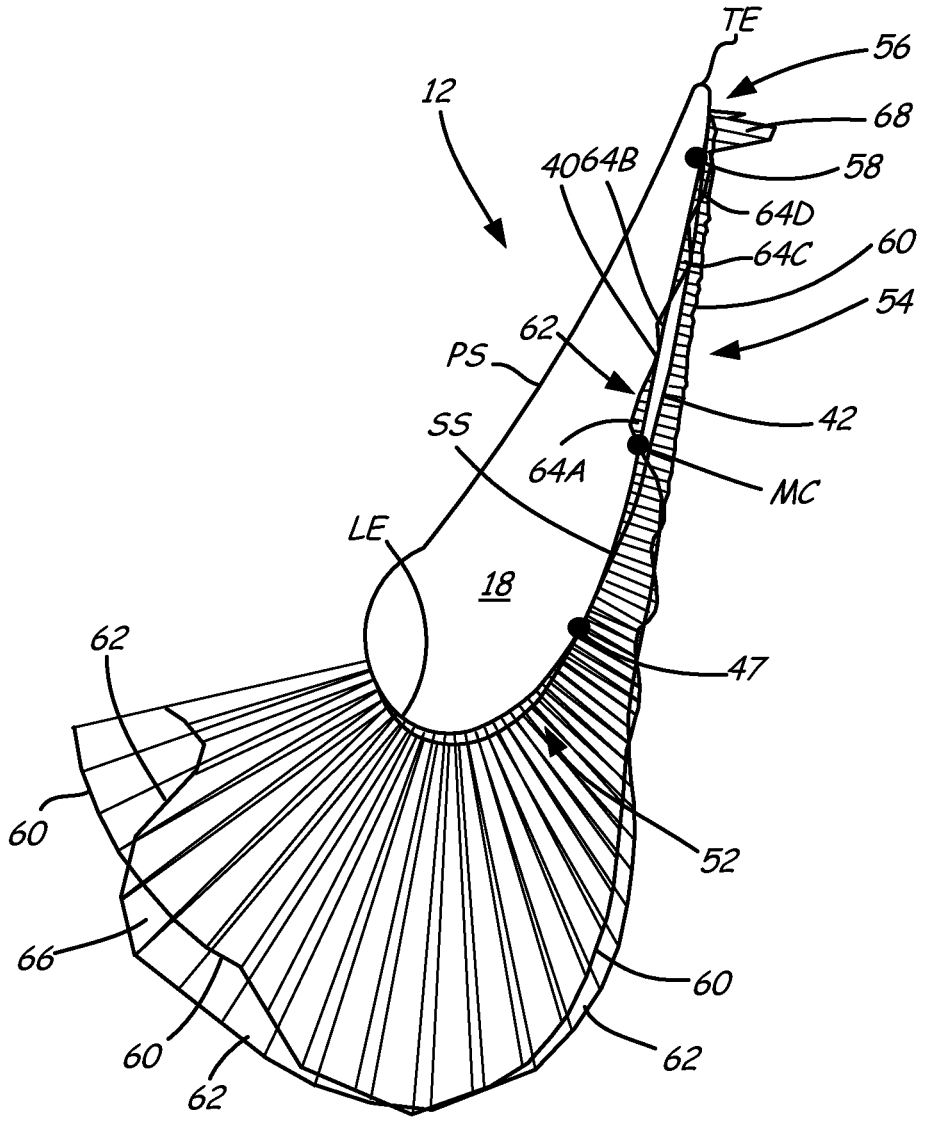
FIG. 5 is a schematic cross-section of the airfoil of the high pressure stator vane of FIG. 3 showing the contoured suction side according to the present invention relative to a prior art airfoil suction side shape.

Inlet guide vane 12 and turbine blade 14 each comprises one of an annular array of airfoils disposed radially about engine centerline CL. Airfoils 18 and 22 of the present invention are contoured to reduce potential field interactions between adjacent arrays of airfoils, as discussed with reference to FIG. 2. The location of the contouring is shown with reference to airfoil 18 in FIG. 3, although the contouring is also equivalently applicable to airfoil 22. FIGS. 4A and 4B show a local coordinate system for determining curvature of airfoil 18. FIG. 5 is a diagram defining the curvature of the contouring of airfoil 18. The contouring of airfoils 18 and 22 permits the pressure of cooling air AC to be reduced, as is discussed with reference to FIG. 6. FIG. 7 discusses the placement of suction side cooling holes along the trailing edge of airfoil 22 of FIG. 3, which are permitted due to the suction side contouring of the present invention.

Figure 2:
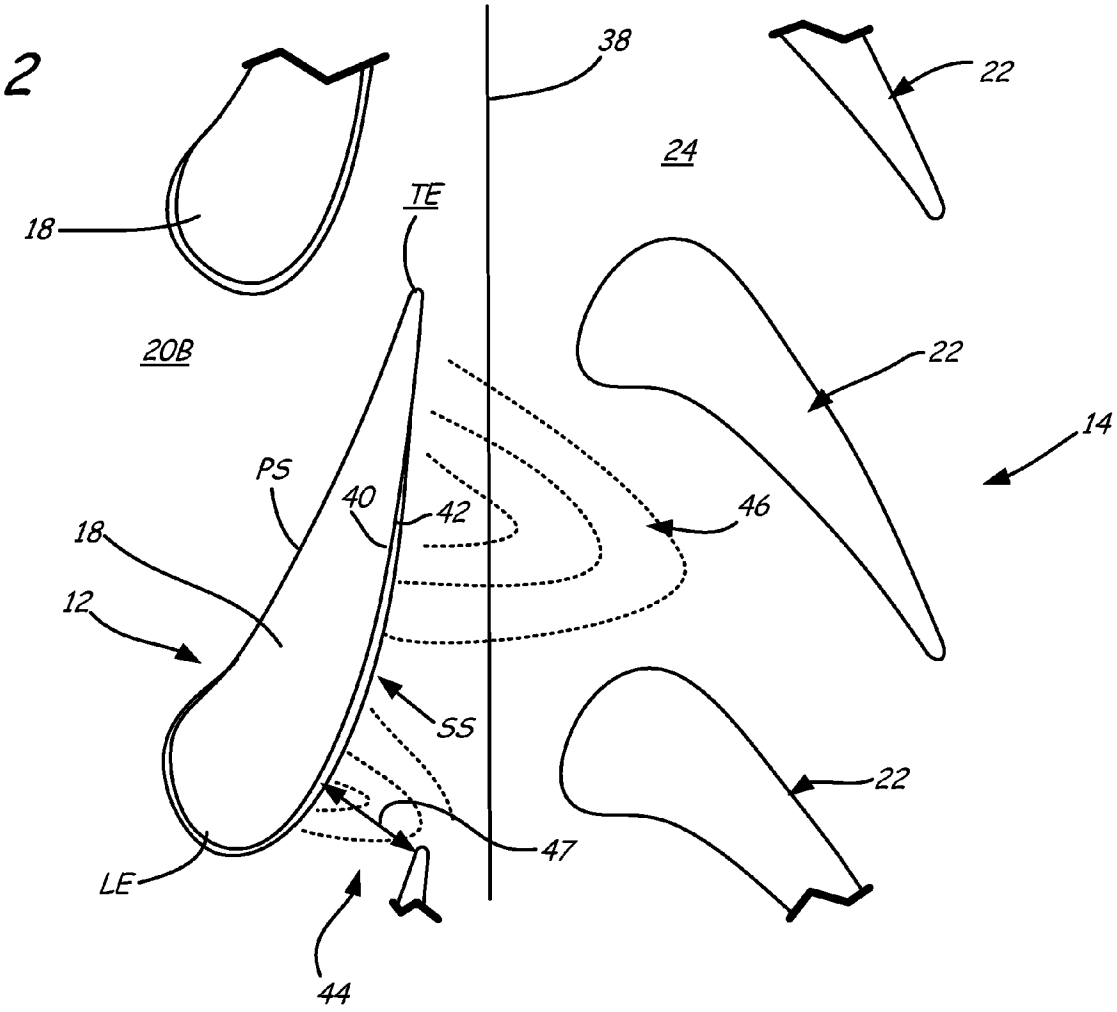
FIG. 2 is a schematic transverse cross-section of the high pressure turbine section taken at section 2-2 of FIG. 1 showing interaction of the rotor blades with potential fields of the stator vanes.

FIG. 2 is a schematic transverse cross-section of high pressure turbine section 10 taken at section 2-2 of FIG. 1 showing interaction of rotor blade airfoils 22 with potential fields of stator vane airfoils 18. Airfoil 18 extends radially outward (out from the plane of FIG. 2) from shroud 20B, while airfoil 22 extends radially outward from platform 24. Shroud 20B and platform 24 are disposed along gap 38 produced by labyrinth seal 33 (FIG. 1). Airfoil 18 includes leading edge LE, trailing edge TE, pressure side PS and suction side SS. Suction side SS includes trailing edge contouring 40 of the present invention relative to conventional trailing edge shaping 42. Trailing edge contouring 40 produces potential field 44, while conventional trailing edge shaping 42 produces potential field 46. Pressure side PS and suction side SS of adjacent airfoils 18 form an inter-blade passage through which combustion gases GC flow to direct air onto blades 22. The narrowest portion of the inter-blade passage forms throat 47.

Potential fields 44 and 46 are generated by the flow of combustion gas GC over suction side SS. Potential fields comprise static pressure distributions surrounding the airfoil, as is known in the art. As shown in FIG. 2, potential field 46 of prior art design has a greater magnitude than that of potential field 44. Additionally, potential field 46 is closer to trailing edge TE of airfoil 18 as compared to potential field 44. The combination of a large magnitude and trailing edge proximity cause potential field 46 to extend far enough downstream (toward the right of FIG. 2) to impact airfoils 22 of rotor blades 14. Thus, as rotor blades 14 rotate upward with reference to FIG. 2, each airfoil 22 impacts potential field 46. The interaction of airfoil 22 with a potential field reduces efficiency of turbine section 10, such as by varying the inlet condition of airflow into airfoils 22. Further, impact of blade 14 with potential fields 46 can cause high cycle fatigue and stress within airfoil 22. Potential field 46 is generated by the flow of gas over the constant positive curvature of shaping 42 of suction side SS.

Contouring 40 of the present invention reduces the magnitude of potential field 44 and shifts the potential field away from trailing edge TE toward leading edge LE. As such, potential field 44 is shifted away from (toward the left of FIG. 2) gap 38. Engagement of potential field 44 with airfoils 22 of rotor blades 14 is therefore reduced and the effects mitigated. Potential field 44 is reduced in magnitude and shifted toward leading edge LE by contouring 40 of the present invention of pressure side PS. Specifically, contouring 40 introduces a negative curvature into suction side SS.

Figure 3:
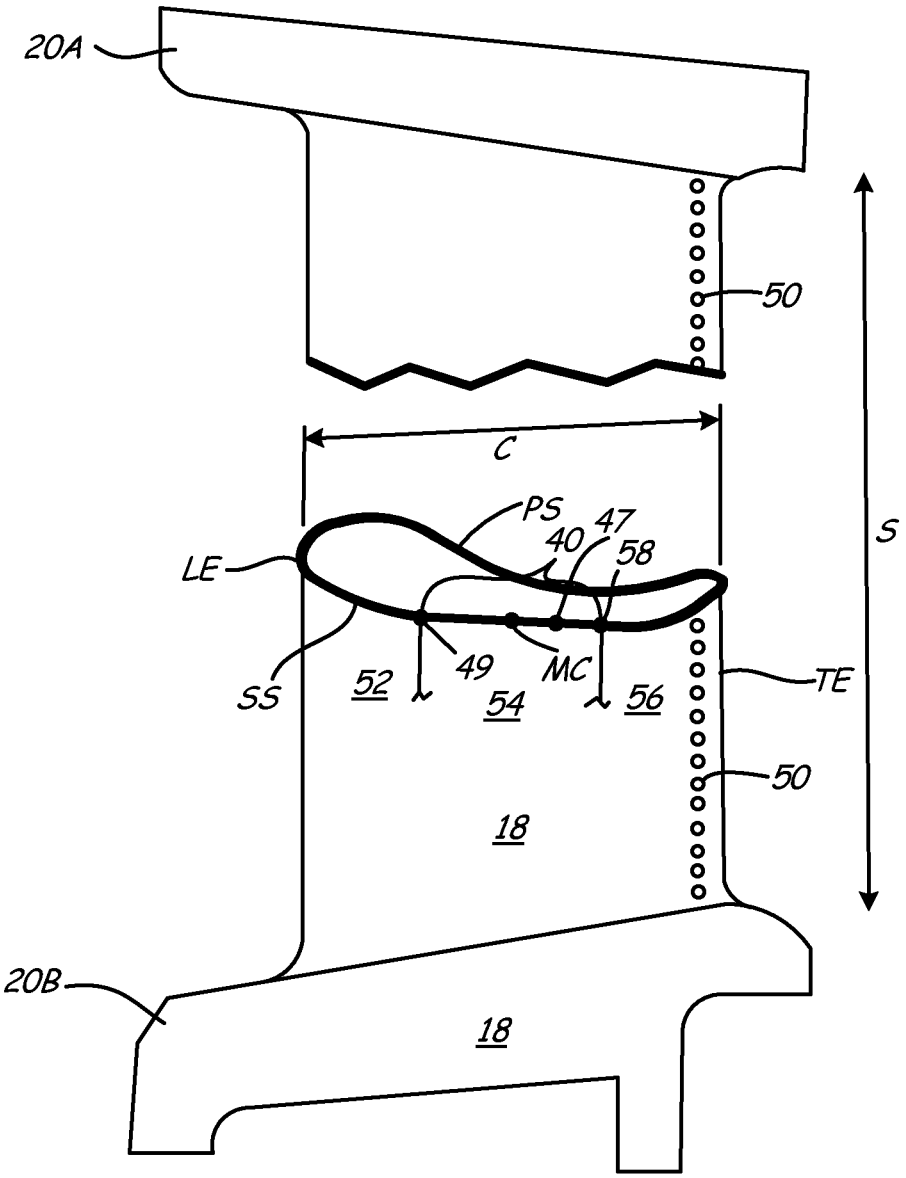
FIG. 3 is a perspective view of the high pressure stator vane used in the turbine section of FIG. 1 having an airfoil with a contoured suction side and suction side cooling holes according to the present invention.

FIG. 3 is a perspective view of vane 12 of FIG. 1. Vane 12 includes inner shroud 20B and airfoil 18. Span S of airfoil 18 extends radially from inner shroud 20B to outer shroud 20A. Pressure side PS and suction side SS of airfoil 18 extend generally arcuately along shroud 20B from leading edge LE to trailing edge TE across chord length C, which includes mid-chord point MC. Inner shroud 20B and outer shroud 20A (not shown) join vane 12 to high pressure turbine section 10 (FIG. 1). Inner shroud 20B and outer shroud 20A define the radial extents of airfoil 18 and a primary flow path containing hot combustion gas GC, which are separated from cavity 36 (FIG. 1). Airfoil 18 includes trailing suction side cooling holes 50 disposed along trailing edge TE. Airfoil 18 may also include other cooling holes such as pressure side cooling holes as is known in the art. In the embodiment shown, cooling holes 50 are arranged in a column, but may be arranged in other arrays such as in multiple, staggered columns. Airfoil 18 includes internal cooling passages for directing cooling air AC into vane 12 and out cooling holes 50. Typically, cooling air is directed into inner shroud 20B at the radially inner end of airfoil 18 from a high pressure compressor.

Contouring 40 of the present invention comprises a plurality of inflections in the curvature of suction side SS. Specifically, suction side SS is primarily convex outside of forward and aft inflection points of contouring 40 and substantially flat therebetween. For clarity, suction side SS is divided into leading edge region 52, mid-chord region 54 and trailing edge region 56. Leading edge region 52 extends from leading edge LE to approximately forward point 49, which is located upstream of airfoil throat location 47. In one embodiment, forward point 49 comprises approximately twenty-five percent of chord C from leading edge LE aftward. Mid-chord region 54 extends approximately from forward point 49 to aft point 58, which comprises approximately twenty-five percent of chord C from trailing edge TE forward. Trailing edge region 56 extends from aft point 58 to trailing edge TE. Throat 47 is shown located aft of mid-chord point MC, which comprises a point located halfway along the length of chord C, in the disclosed embodiment. However, throat 47 may be located forward of mid-chord point MC in other embodiments. In one embodiment, contouring 40 of the present invention extends from throat 47 to point 58. In another embodiment, contouring 40 extends from mid-chord point MC to aft point 58. In another embodiment, contouring 40 of the present invention extends from anywhere in mid-chord region 54 to point 58.

FIG. 4A is schematic cross-section of airfoil 18 of the high pressure stator vane of FIG. 3 showing a local coordinate system for determining curvature of airfoil 18. FIG. 4B is a close-up of airfoil 18 of FIG. 4A showing orthogonal tangent and normal vectors of the local coordinate system. FIGS. 4A and 4B are discussed concurrently. The curvature of airfoil 18 is defined by the second derivative of the equation defining the outer shape of airfoil 18 given a defined, local coordinate system. FIG. 4A shows a local coordinate system for airfoil 18 defined by orthogonal normal and tangent vectors along the surface of airfoil 18. FIG. 4A shows a few exemplary normal $\vec{N}$ and tangent $\vec{T}$ vectors at a select number of locations on airfoil 18. At a given location on the airfoil surface, the curvature can be determined using the following equation:

$$K = \frac{|t''|}{(1 + (t')^2)^{\frac{3}{2}}} \qquad \text{Equation (0001)}$$

where t=f(n) represents a function describing the shape of the airfoil surface defined with respect to the local coordinate system shown in FIG. 4B. The parameter t' and t" represent the first and second derivatives of this local airfoil surface shape function, respectively.

FIG. 5 is a schematic cross-section of airfoil 18 of high pressure stator vane 12 of FIG. 3 showing contoured suction side SS according to the present invention relative to prior art airfoil suction side 42. Pressure side PS extends generally concavely from leading edge LE to trailing edge TE. Suction side SS of the present invention extends in a predominantly convex fashion from leading edge LE to trailing edge TE. Suction side SS, however, includes mid-chord-region 54 having contouring 40, which is less convex than leading edge region 52 and trailing edge region 56. In one embodiment contouring 40 is approximately flat. In another embodiment, contouring 40 is slightly concave. Conventional suction side curvature is shown at shaping 42.

As shown, curvature lines 60 can be developed from shaping 42, while curvature lines 62 can be developed from contouring 40. Curvature lines 60 and 62 are constructed using segments extending perpendicularly from the suction side SS with lengths representing the magnitude of the suction side SS curvature at the given location. Curvature lines extending from airfoil 18 indicate positive (convex) curvature, while curvature lines extending into airfoil 18 indicate negative (concave) curvature.

Conventional shaping 42 of suction side SS comprises positive curvature all the way from leading edge LE to trailing edge TE. The curvature of conventional shaping 42 generally decreases from leading edge LE to trailing edge TE.

Curvature of suction side SS of the present invention is positive from leading edge LE to a point within mid-chord region 54 and from point 58 to trailing edge TE. Contouring 40 is slightly negative or flat between mid-chord region 54 and point 58. Contouring 40 may begin anywhere from throat point 47 to aft of mid-chord point MC, extending to point 58. Point 58 is located within twenty-five percent of chord length C starting at trailing edge TE. In another embodiment, point 58 is located at ten percent of chord length C starting at trailing edge TE.

Curvature lines 62 include a plurality of small continuously connected regions 64A-64D each having a very slight positive or a very slight negative curvature. The curvature in each of regions 64A-64D, whether positive or negative, is less than the curvature of forward segment 66 and aft segment 68 of curvature lines 62. The net effect of small regions 64A-64D is to produce a generally flat, or curveless, portion of suction side SS. The number of regions can vary from the embodiment depicted. In yet other embodiments of contouring 40, curvature lines 62, such as between mid-chord point MC and point 58, have zero magnitude so that suction side SS is truly flat in this area.

Figure 6:
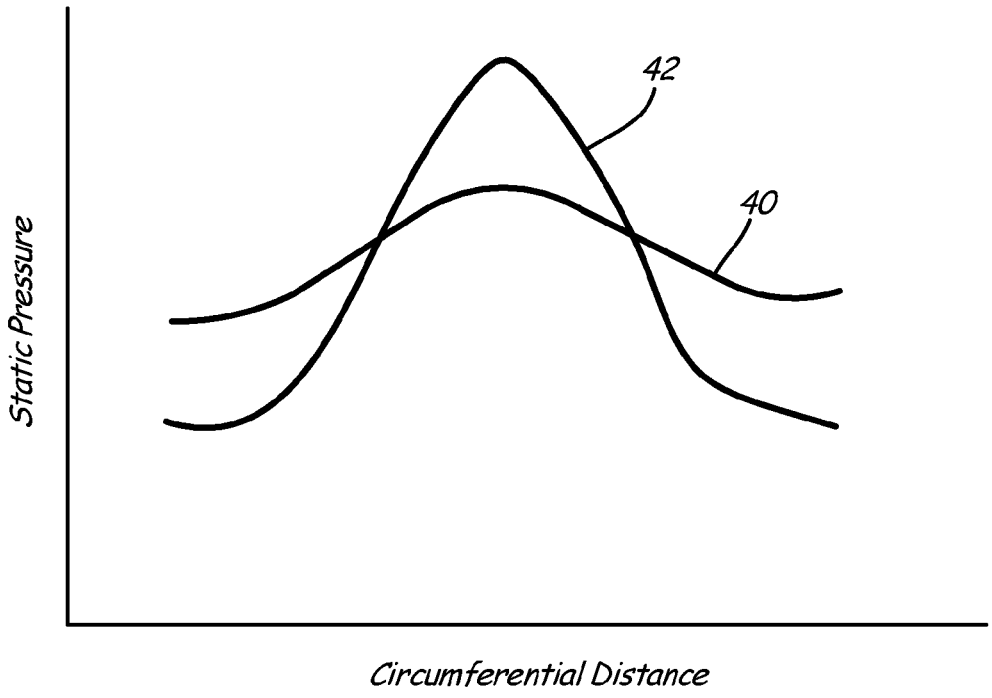
FIG. 6 is a graph showing static pressure traces downstream of the airfoil of FIG. 5 at different circumferential positions near the platform.
Figure 7:
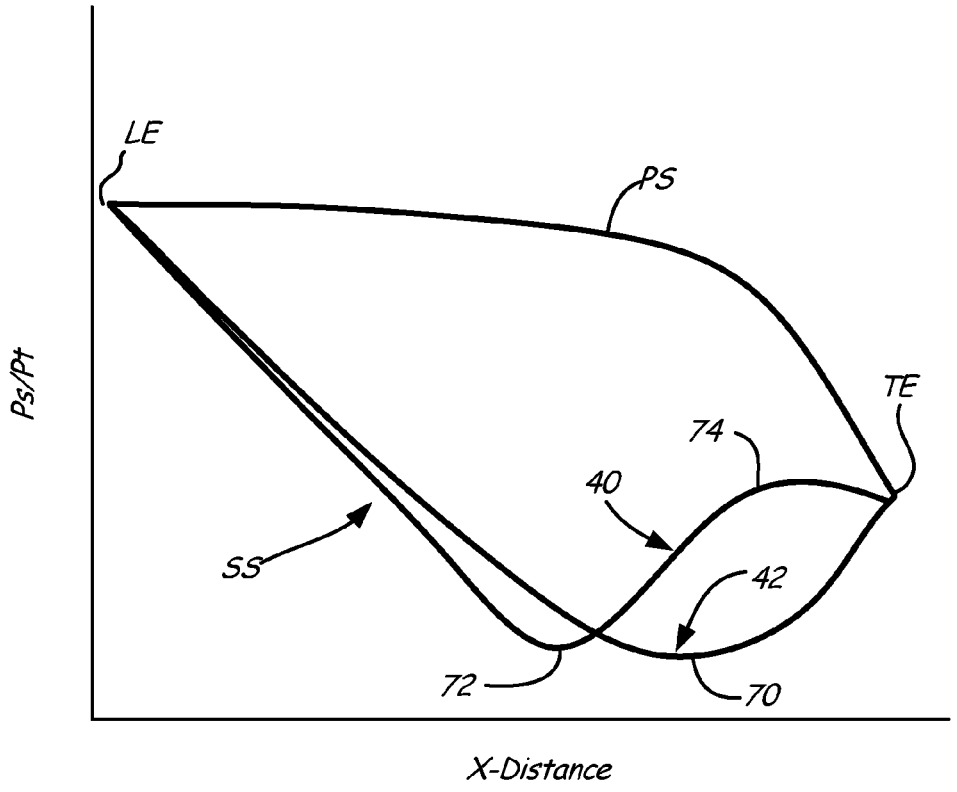
FIG. 7 is a graph showing pressure at different positions along the pressure side and suction side of the airfoil of FIG. 5.

FIG. 6 is a graph showing traces of static pressure generated by potential fields behind airfoil 18 of FIG. 5 for different circumferential positions downstream of airfoil 18 and the endwall along gap 38 (FIG. 2) for 1) contouring 40 of the present invention, and 2) shaping 42 of prior art airfoils. Static pressure has a maximum value directly behind the airfoil for each configuration. As shown, contouring 40 has much less variation in static pressure. Contouring 40 has a higher minimum value than shaping 42, but has a much lower peak magnitude than shaping 42. This is significant in reducing the pressure of cooling air AC delivered to cavity 36 (FIG. 1).

Due to their location just downstream of the combustion process, stator vanes 12 of high pressure turbine section 10 are subject to extremely high temperatures, often times exceeding the melting point of the alloys comprising airfoils 18. In order to maintain the high pressure turbine components at temperatures below their melting points it is necessary to, among other things, cool the components with a supply of relatively cooler cooling air AC, typically bled from a compressor. As shown in FIG. 1, cooling air AC is passed through the interior of high pressure turbine section 10, inward of vane shrouds 20A and blade platforms 24 to prevent over-heating of these and other components of the gas turbine engine. Cooling air AC must be maintained at a sufficiently high pressure to prevent hot combustion gas GC from leaking through labyrinth seal 33 (FIG. 1) between shrouds 20A and platforms 24 at gap 38 (FIG. 2). In particular, the static pressure distributions of the potential fields surrounding the vanes and blades must be balanced by the bled cooling air. However, maintaining high bleed air pressure directly reduces the efficiency of the compressor, thereby reducing overall engine efficiency. With contouring 40 of the present invention, the variation of the static pressure field behind airfoils 18 is reduced, thereby also reducing the peak magnitude of the static pressure fields. This permits the pressure of the bled cooling air to be reduced while still being able to overcome the pressure within gas path 34 at all circumferential positions. Although shaping 42 may have a lower minimum static pressure, it is still necessary to pressurize the bleed air to overcome the peak magnitude so that combustion gas is prevented from leaking through gap 38 at all circumferential positions. Reduction in the pressure of the cooling air bled from the compressor increases the overall operating efficiency of the gas turbine engine.

FIG. 7 is a representative graph showing pressure at different positions along pressure side PS and suction side SS of airfoil 18 of FIG. 5. Suction side SS is shown including 1) contouring 40 of the present invention, as well as 2) shaping 42 of conventional airfoil suction sides. With shaping 42, airflow along suction side SS accelerates from leading edge LE toward minimum static pressure point 70, and decelerates from point 70 to trailing edge TE. Decelerating airflow produces adverse pressure gradients that tend to thicken the boundary layer and that may separate flow from the airfoil. Thick boundary layer flows are unstable and represent undesirable locations to position cooling air holes in an airfoil. For example, the thickened boundary layer produces the potential for separation which, not only increases losses, but interferes with the ability of the cooling air to provide film cooling. Furthermore, penetration of the cooling air into the unstable boundary layer further destabilizes the airflow.

Contouring 40 of the present invention pushes the minimum static pressure point forward toward leading edge LE at leading curvature inflection point 72, and produces a trailing edge region of local acceleration aft of trailing curvature inflection point 74. In various embodiments, inflection point 72 is located at or near mid-chord point MC, or at or near throat 47, as discussed above. Likewise, inflection point 74 corresponds to point 58 discussed above. The trailing edge region of local acceleration provides a suitable length of accelerating boundary layer flow for positioning of cooling holes 50, as shown in FIG. 3. The cooling air emanating from each cooling hole 50 thereby enters a more stable boundary layer that provides a damping effect to the instabilities generated by the cooling air. Thus, the cooling air is better able to stay attached to airfoil 18 and provide film cooling. This also allows for a more effective layout of the cooling air, thereby reducing the number of cooling holes 50 required to provide the desired cooling. In another embodiment, cooling holes are placed in locations aft of the forward convex portion of the airfoil; these regions would include the approximately flat portions of the airfoil as well as the aft convex region.

Contouring 40 of the present invention is suitable for use in airfoils of any type, such as turbine blades and turbine vanes. Contouring 40 is, however, particularly effective in shifting the minimum static pressure point forward and reducing downstream static pressure fields in sub-sonic flow. Thus, overall efficiency of the gas turbine engine can be improved by reducing the pressure of cooling air bled from a compressor, and reducing interaction inefficiencies of airflow into subsequent stages of airfoils.

Although described with reference to a first stage high pressure turbine blade airfoil, the invention may be used in other airfoils. For example, the suction side contouring of the present invention may be used in second stage high pressure turbine blade airfoils, turbine vane airfoils of any stage, low pressure turbine blades and vanes.

The following are non-exclusive descriptions of possible embodiments of the present invention.

An airfoil for a gas turbine engine comprises a radially extending body having a transverse cross-section comprising: a leading edge; a trailing edge; a pressure side extending between the leading edge and the trailing edge with a predominantly concave curvature; and a suction side extending between the leading edge and the trailing edge with a predominantly convex curvature that includes an approximately flat portion flanked by forward and aft convex portions.

The airfoil of the preceding paragraph can optionally include, additionally and/or alternatively, any one or more of the following features, configurations and/or additional components:

- an approximately flat portion formed by a series of local curvature changes that produce inflection points in the convex curvature of the suction side.
- an approximately flat portion that is defined by a plurality of changes in sign of the second derivative of a curve defining the suction side.
- a radially extending body that defines a chord length and wherein the approximately flat portion is located within a mid-chord region of the airfoil on the suction side.
- an approximately flat portion that joins the forward convex portion at a mid-chord point of the airfoil.
- an approximately flat portion that joins the forward convex portion at a throat of the airfoil.
- an approximately flat portion that includes a plurality of small segments having local concave and convex curvatures less curved than the forward and aft convex portions.
- an aft convex portion that extends from the trailing edge to a point within a trailing edge region of the airfoil comprising approximately an aft twenty-five percent of a chord length of the airfoil.
- one or more arrays of cooling holes extending along the suction side in the aft convex portion, or within both the approximately flat portion of the airfoil as well as the aft convex portion.
- a radially extending body that comprises a turbine vane or a turbine blade.

A turbine stage for a gas turbine engine comprises: an array of airfoils, each airfoil comprising a radially extending body having a transverse cross-section comprising: a leading edge; a trailing edge; a chord length extending between the leading edge and the trailing edge; a pressure side extending between the leading edge and the trailing edge with a predominantly concave curvature; and a suction side extending between the leading edge and the trailing edge with a predominantly convex curvature that includes a series of local curvature changes that produce inflection points in the convex curvature of the suction side, wherein the series of local curvature changes extend to within twenty-five percent of the chord length starting from the trailing edge.

The turbine stage of the preceding paragraph can optionally include, additionally and/or alternatively, any one or more of the following features, configurations and/or additional components:

- a series of local curvatures that define a predominantly concave shape.
- a series of local curvatures that define a predominantly flat shape.
- a predominantly flat shape that comprises a plurality of small segments having local concave and convex curvatures less curved than other portions of the suction side.
- a series of local curvatures that is defined by forward and aft inflection points that change a sign of the second derivative of a curve defining the suction side.
- a forward inflection point that is located at the mid-chord of the airfoil.
- an array of airfoils including: a first airfoil; and a second airfoil circumferentially spaced from the first airfoil to define a throat where a distance between the first and second airfoils is at a minimum; wherein a forward inflection point on the pressure side of the first airfoil is located at the throat.
- an aft inflection point that is located within ten percent of the chord length starting from the trailing edge.
- a row of cooling holes extending along the radially extending body in a trailing edge region of the suction side.
- a radially extending body that comprises a vane or a blade.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An airfoil for a gas turbine engine, the airfoil comprising:

- a radially extending body having a transverse cross-section comprising:
  - a leading edge extending from a pressure side to a suction side;
  - a trailing edge extending from the pressure side to the suction side;
  - the pressure side extending between the leading edge and the trailing edge with a predominantly concave curvature; and
  - the suction side extending between the leading edge and the trailing edge with a predominantly convex curvature, the suction side comprising:

a forward portion aft of the leading edge, an aft portion forward of the trailing edge, and a generally flat portion extending from the forward portion to the aft portion, wherein the forward portion has positive curvature from the leading edge to the point at which it meets the generally flat portion, and wherein the aft portion has positive curvature from the point at which it meets the generally flat portion to the trailing edge.

2. The airfoil of claim 1 wherein the generally flat portion is formed by a series of local curvature changes that produce inflection points in the convex curvature of the suction side.

3. The airfoil of claim 1 wherein the generally flat portion is defined by a plurality of changes in sign of the second derivative of a curve defining the suction side.

4. The airfoil of claim 1 wherein the radially extending body defines a chord length and wherein the generally flat portion spans a mid-chord point of the airfoil on the suction side.

5. The airfoil of claim 4 wherein the generally flat portion joins the forward portion at the mid-chord point of the airfoil.

6. The airfoil of claim 1 wherein the generally flat portion joins the forward portion at a throat of the airfoil.

7. The airfoil of claim 1 wherein the generally flat portion includes a plurality of small segments having local concave and convex curvatures less curved than the forward and aft portions.

8. The airfoil of claim 1 wherein the aft portion extends from the trailing edge to a point within a trailing edge region of the airfoil comprising approximately an aft twenty-five percent of a chord length of the airfoil.

9. The airfoil of claim 1 and further comprising one or more arrays of cooling holes extending along the suction side aft of the forward convex portion of the airfoil.

10. The airfoil of claim 1 wherein the radially extending body comprises a turbine vane or a turbine blade.

11. A turbine stage for a gas turbine engine, the turbine stage comprising:

an array of airfoils, each airfoil comprising a radially extending body having a transverse cross-section comprising:

a leading edge extending from a pressure side to a suction side;

a trailing edge extending from the pressure side to the suction side;

a chord length extending between the leading edge and the trailing edge;

the pressure side extending between the leading edge and the trailing edge with a predominantly concave curvature; and the suction side extending between the leading edge and the trailing edge with a predominantly convex curvature that includes a forward portion aft of the leading edge having positive curvature, an aft portion forward of the trailing edge having positive curvature, and an intermediate portion extending from the forward portion to the aft portion, wherein the intermediate portion has a series of local curvature changes such that regions of the intermediate portion between curvature changes have very slight positive curvature or very slight negative curvature compared to the curvatures of the forward and aft portions so that, overall, the intermediate portion is generally flat or curve-less, wherein the intermediate portion extends to within twenty-five percent of the chord length starting from the trailing edge, and wherein the aft portion extends to the trailing edge, such that the aft portion has positive curvature from the intermediate portion to the trailing edge.

12. The turbine stage of claim 11 wherein the forward and aft portions change a sign of the second derivative of a curve defining the suction side.

13. The turbine stage of claim 12 wherein the aft inflection point is located within ten percent of the chord length starting from the trailing edge.

14. The turbine stage of claim 11 and further comprising a one or more rows of cooling holes extending along the radially extending body in a region of the suction side aft of the series of local curvature changes.

15. The turbine stage of claim 11 wherein the radially extending body comprises a vane or a blade.

16. The turbine stage of claim 11, wherein the generally flat portion has a series of local curvature changes such that regions of the generally flat portion between curvature changes have very slight positive curvature or very slight negative curvature compared to the forward portion and the aft portion.

* * * * *